US009274482B2

(12) United States Patent
Nakase et al.

(10) Patent No.: US 9,274,482 B2
(45) Date of Patent: Mar. 1, 2016

(54) IMAGE FORMING APPARATUS WITH DEVELOPING CONTRAST CONTROL

(71) Applicant: CANON KABUSHIKI KAISHA, Tokyo (JP)

(72) Inventors: Takahiro Nakase, Moriya (JP); Hideki Fujita, Moriya (JP); Michihito Yamazaki, Tokyo (JP); Yasushi Takeuchi, Moriya (JP); Kousuke Takeuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 13/900,863

(22) Filed: May 23, 2013

(65) Prior Publication Data

US 2013/0322901 A1 Dec. 5, 2013

(30) Foreign Application Priority Data

Jun. 4, 2012 (JP) ..... 2012-127378

(51) Int. Cl.

*G03G 15/00* (2006.01)
*G03G 15/08* (2006.01)
*G03G 15/06* (2006.01)

(52) U.S. Cl.

CPC ..... *G03G 15/5041* (2013.01); *G03G 15/0806* (2013.01); *G03G 15/5054* (2013.01); *G03G 15/5058* (2013.01); *G03G 15/065* (2013.01); *G03G 15/08* (2013.01)

(58) Field of Classification Search

CPC . G03G 15/08; G03G 15/065; G03G 15/5041; G03G 15/5054; G03G 15/5058
USPC ..... 399/49, 53, 55
See application file for complete search history.

(56) References Cited

U.S. PATENT DOCUMENTS 6,483,997 B1 11/2002 Nakazato
7,251,423 B2 7/2007 Shimura et al.
7,664,411 B2 * 2/2010 Komiya ..... 399/38

(Continued)

FOREIGN PATENT DOCUMENTS

CN 101075104 A 11/2007
CN 101140438 A 3/2008

(Continued)

OTHER PUBLICATIONS

Office Action in Chinese Patent Application No. 201310218428.9, dated Jun. 24, 2015.

*Primary Examiner* — David Gray
*Assistant Examiner* — Andrew V Do
(74) *Attorney, Agent, or Firm* — Fitzpatrick, Cella, Harper & Scinto

(57) ABSTRACT

A toner image for measurement of an area coverage modulation of 90% or more is formed on a photosensitive drum in a non-image formation, and a setting condition for defining a developability of a toner image in an image formation is set so that a detection result of an optical sensor detecting the toner image for measurement becomes a preset target value. The target value is set to be lower as a value of the setting condition increases from a lower side to a higher side of the developability. The target value is set so that a color difference ΔE of an image having half the maximum image density obtained after the setting condition is set with respect to an image having half the maximum image density obtained after the setting condition is set in a setting mode with use of unused developer is 6.5 or less.

5 Claims, 12 Drawing Sheets

(56) References Cited

U.S. PATENT DOCUMENTS

| | | | | |
|---|---|---|---|---|
| 7,840,147 | B2 | 11/2010 | Morikuni | |
| 2004/0037577 | A1 * | 2/2004 | Shimura et al. | 399/49 |
| 2010/0054775 | A1 | 3/2010 | Nakase | |
| 2011/0123209 | A1 * | 5/2011 | Akita | 399/49 |

FOREIGN PATENT DOCUMENTS

| | | | |
|---|---|---|---|
| CN | 101154071 | A | 4/2008 |
| JP | 2001-42580 | A | 2/2001 |
| JP | 2007-310015 | A | 11/2007 |
| JP | 2008-49694 | A | 3/2008 |

* cited by examiner

IMAGE FORMING APPARATUS WITH DEVELOPING CONTRAST CONTROL

BACKGROUND OF THE INVENTION

1. Field of the Invention

The present invention relates to an image forming apparatus that is configured to measure toner bearing amounts of at least two toner images, which were formed for measurement purposes and which have different toner image forming conditions, to set a toner image forming condition for image formation, and more particularly, to a control for suppressing density change in a halftone image before and after the toner image forming condition is set.

2. Description of the Related Art

An image forming apparatus is widely used, which is configured to develop an electrostatic image formed on an image bearing member into a toner image by a developing device. The apparatus transfers the developed toner image directly, or via an intermediate transfer member, onto a recording material. The apparatus also uses a fixing device to fix the image onto the recording material by heating and pressurizing the recording material, on which the toner image has been transferred.

In the image forming apparatus, in order to enhance the reproducibility of the image density of the fixed image, a setting mode is executed prior to image formation, in order to set a setting condition for electrically defining the developability of the toner image between a developer carrying member and the image bearing member at the time of image formation.

In Japanese Patent Application Laid-Open No. 2001-42580, in the setting mode, a predetermined developing contrast is set in the image forming apparatus to form a toner image for measurement (patch image), and a toner bearing amount of the toner image for measurement is measured with the use of an optical sensor disposed opposite to the image bearing member or the intermediate transfer member. The developing contrast refers to a potential difference (see FIG. 3) between the potential of an image section, of an electrostatic image formed on the image bearing member, and a DC voltage to be applied to the developer carrying member.

Then, in order to obtain a toner image having a certain target toner bearing amount based on the result of measurement of the toner bearing amount of the toner image formed for measurement, the developing contrast for the image formation, and the electrostatic image forming condition or the developing condition to obtain the developing contrast are adjusted.

In Japanese Patent Application Laid-Open No. 2001-42580, the setting mode is executed in a state in which a toner image formed for measurement and having a toner bearing amount close to the maximum density that can be output as the fixed image is formed on the image bearing member. This is because the maximum density of the fixed image to be output in the image formation is ensured.

However, when the setting mode is executed using the toner image formed for measurement and having the toner bearing amount close to the maximum density, the density of an image having maximum density is kept equal before and after the setting mode is executed, but the image density of a halftone image varies significantly in some cases. For example, in a case where the developability of the developing device decreases, due to the deterioration of toner, change of temperature and humidity, or the like, when the setting mode is executed to equally set the maximum density of an output image, the reproducibility of the image density of the halftone image is significantly diminished in some cases (Comparative Example 1).

In this case, it is possible to measure the toner bearing amounts of the toner images formed for measurement having a plurality of levels of medium gray scale, and to perform gray scale conversion, called gamma correction, to cancel the difference in image density generated in the medium gray scale (Comparative Example 2). However, when gamma correction is executed, a down-time therefor is generated in the image forming apparatus.

SUMMARY OF THE INVENTION

It is an object of the present invention to provide an image forming apparatus configured to set a setting condition for electrically defining developability of a toner image between a developer carrying member and an image bearing member at the time of image formation while reducing down-time in a manner in which the densities of both the maximum density image and a halftone image are reproducible.

According to an embodiment of the present invention, an image forming apparatus comprising: an image bearing member; a developing device having a developer carrying member configured to carry developer, the developing device being configured to develop an electrostatic image formed on the image bearing member; a sensor configured to detect a toner bearing amount of a toner image developed by the developing device; and a control portion configured to set a development condition at a time of image formation based on a detection result of toner images formed for measurement purposes according to a plurality of different development conditions and on different target values set in advance according to development conditions to be set at the time of image formation.

Further features of the present invention will become apparent from the following description of embodiments with reference to the attached drawings.

DESCRIPTION OF THE EMBODIMENTS

In the following, an embodiment of the present invention is described in detail with reference to the drawings. The present invention is also applicable to another embodiment in which a part of or the entire configuration of the embodiment is replaced with an alternative configuration as long as the fluctuations in image density at a medium gray scale may be significantly reduced while causing slight fluctuations in image density at the maximum gray scale, which is output before or after a setting mode is executed.

Therefore, the present invention is applicable as long as an image forming apparatus that is configured to transfer a toner image onto a recording material is used, regardless of monochrome/full-color, sheet-fed type/recording material conveying type/intermediate transfer type, one-component developer/two-component developer, the charging system, the electrostatic image forming system, the developing system, and the transfer system. An optical sensor configured to detect a toner bearing amount of a toner image for measurement may be arranged above an image bearing member, an intermediate transfer member, or a recording material conveying member. In this embodiment, merely a main part relating to the formation/transfer of the toner image is described. However, necessary machines, equipment, and casing structures may be added to this embodiment, and thus the present invention is applicable to image forming apparatus for various applications, such as a printer, various printing machines, a copying machine, a fax machine, and a multifunctional peripheral.

<Image Forming Apparatus>

Figure 1:
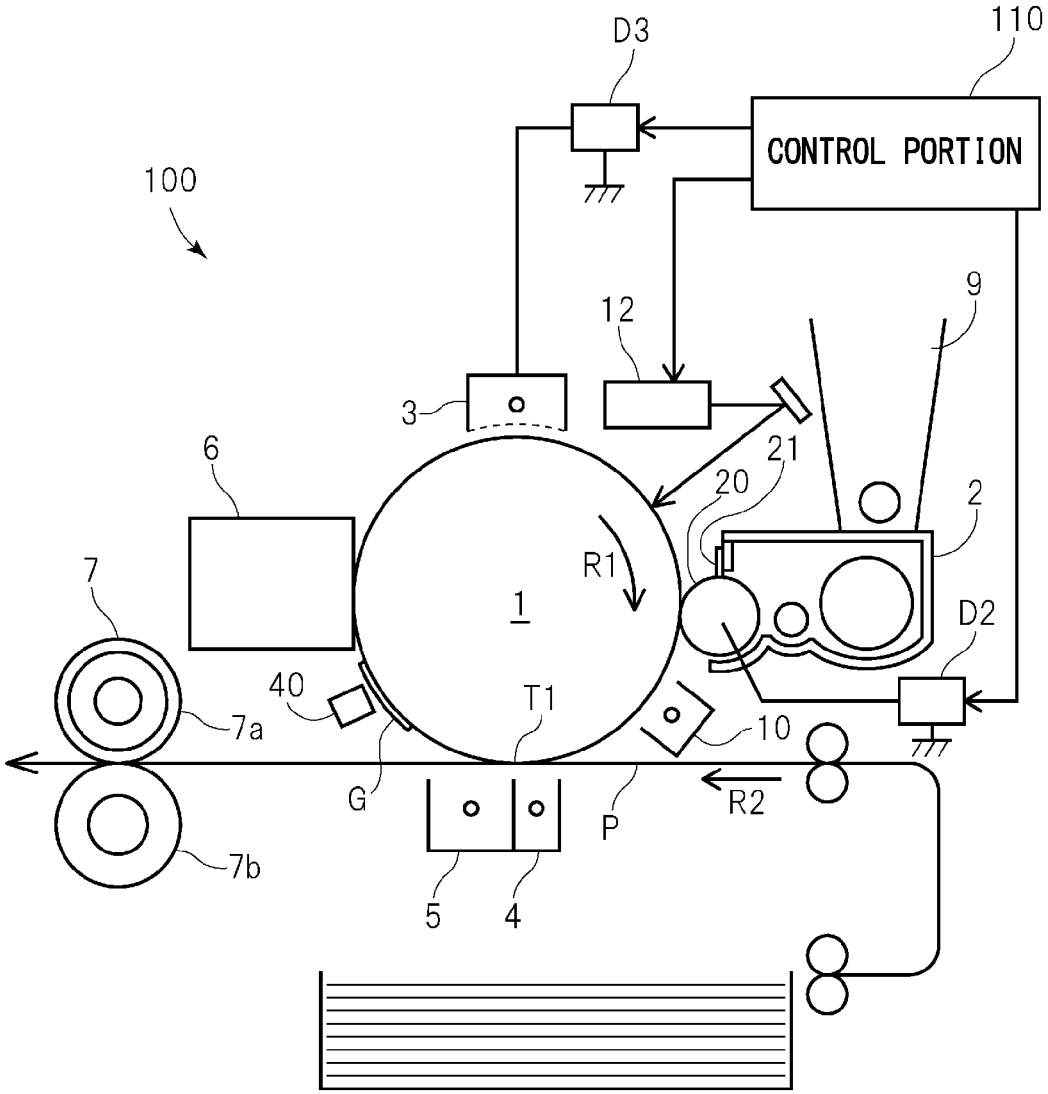
FIG. 1 is an explanatory view of a configuration of an image forming apparatus.
Figure 2:
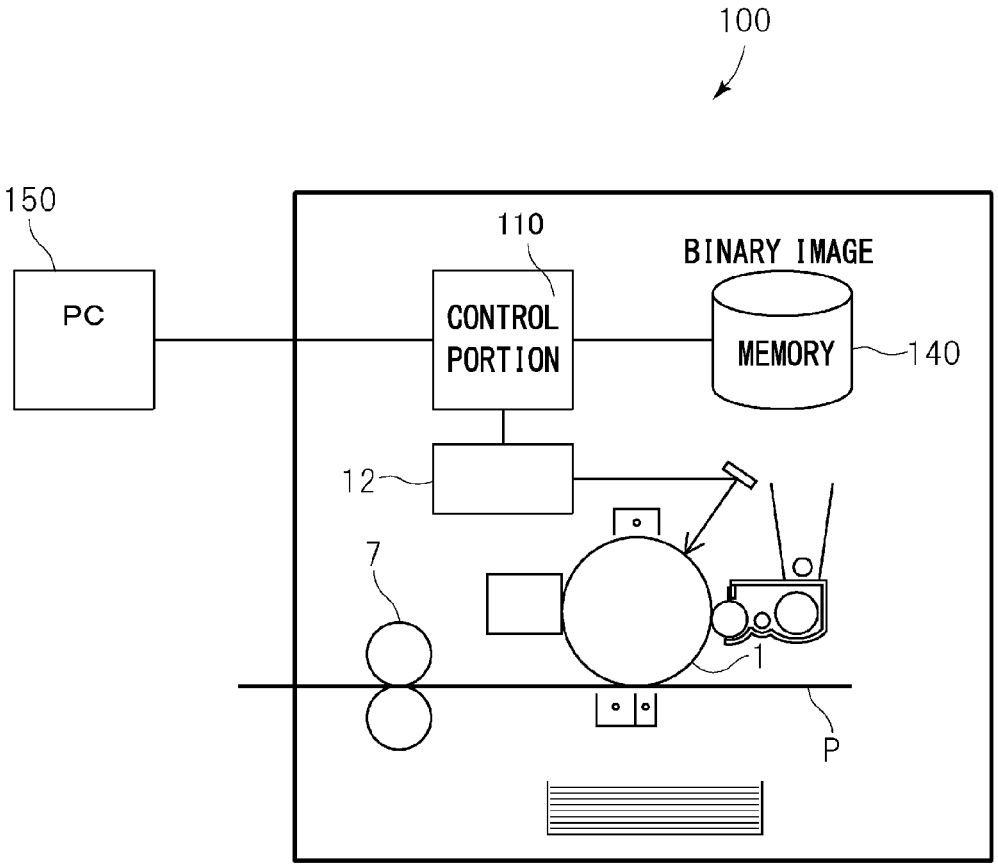
FIG. 2 is a block diagram of a system of the image forming apparatus.

FIG. 1 is an explanatory view of a configuration of an image forming apparatus. FIG. 2 is a block diagram of a system of the image forming apparatus. As illustrated in FIG. 1, an image forming apparatus 100 is a multifunctional printer that uses one-component developer and is configured to continuously form a monochrome image on an A4-sized recording material P in Long Edge Feed at a productivity of 65 sheets per minute.

The image forming apparatus 100 includes a corona charger 3, an exposure device 12, a developing device 2, a pre-transfer charger 10, a transfer charger 4, a separation charger 5, an optical sensor 40, and a drum cleaning device 6, which are arranged around a rotatable photosensitive drum 1. The photosensitive drum 1 is an OPC photosensitive member formed by applying, in a layer form, an OPC (organic photoconductor) photosensitive layer on a surface of a drum base made of aluminum. The photosensitive drum 1 has a negative charging polarity.

The corona charger 3 irradiates the photosensitive drum 1 with charged particles generated by corona discharge to charge the surface of the photosensitive drum 1 into a uniform negative dark section potential VD. A power supply D3 adjusts the output of the corona charger 3 based on the output of a potential sensor (not shown) to set the dark section potential VD in a variable manner.

The exposure device 12 causes the dark section potential VD of the photosensitive drum 1 to discharge through exposure to form an electrostatic image of an image having its potential reduced to a light section potential VL. In the exposure device 12, a laser element is operated based on an image signal obtained by subjecting the image density developed along a scanning line to PWM (pulse width modulation) binary modulation, and the generated laser beam is scanned on the photosensitive drum 1 by a rotary mirror.

The developing device 2 causes a rotatable developing sleeve 20 to carry developer (one-component developer, magnetic toner) to develop the electrostatic image on the photosensitive drum 1 into a toner image. A non-rotatable magnet is disposed on the center in the developing sleeve 20, and the developer carried on the surface of the developing sleeve 20 by the magnetic force of the magnet is rubbed against a developing blade 21 to become charged triboelectrically while the layer thickness of the developer is regulated by the developing blade 21. A power supply D2 applies an oscillation voltage obtained by superimposing an AC voltage Vac onto a negative DC voltage Vdc to the developing sleeve 20. The negatively charged developer on the developing sleeve 20 is transferred onto a relatively positive exposed region of the photosensitive drum 1 at the light section potential VL in response to the oscillation voltage for a discharged area development (reversal development) of the electrostatic image.

A developer replenishing device 9 replenishes the developing device 2 with new developer in accordance with the developer amount consumed along with the development of the electrostatic image on the photosensitive drum 1. The pre-transfer charger 10 irradiates the photosensitive drum 1 with charged particles generated by corona discharge to enhance the charges of the adhering toner image.

The transfer charger 4 irradiates the recording material P with charged particles generated by corona discharge to positively charge the recording material P, and thus the negatively charged toner image on the photosensitive drum 1 is transferred onto the recording material P. The separation charger 5 irradiates the recording material P with charged particles generated by corona discharge to eliminate the charges of the recording material P, and thus the recording material P is separated from the photosensitive drum 1.

The drum cleaning device 6 causes a cleaning blade to scrape the surface of the photosensitive drum 1 to collect the transfer residual toner adhering on the surface of the photosensitive drum 1 after passing through a transfer portion T1. In the fixing device 7, a pressure roller 7*b* is brought into abutment against a fixing roller 7*a* to form a nip portion for the recording material. The fixing device 7 nips and conveys the recording material P separated from the photosensitive drum 1 at the nip portion to pressurize and heat the recording material P, and thus the toner image is melted to fix the image on the surface of the recording material P.

As illustrated in FIG. 2, image data sent from an external computer 150 is converted into an image signal to be stored in a memory 140.

A control portion 110 controls the exposure device 12 with use of the image signal called from the memory 140, to thereby form the electrostatic image of the image on the photosensitive drum 1.

<Developing Contrast>

Figure 3:
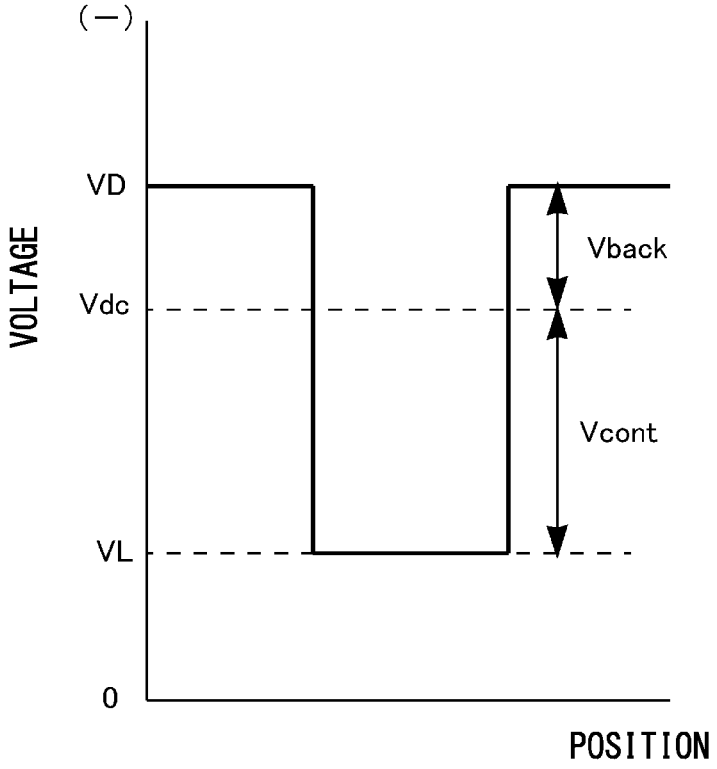
FIG. 3 is an explanatory graph of a developing characteristic in a discharged area development.

FIG. 3 is an explanatory graph showing a developing characteristic in a discharged area development (reversal development). As shown in FIG. 3, the dark section potential VD at a portion of the photosensitive drum 1 opposing to the developing sleeve 20 is −700 V. The light section potential VL, which is an example of an image section potential for electrically defining the developing performance, can be changed by adjusting the dark section potential VD or the output of the laser beam of the exposure device 12. The DC voltage Vdc of the oscillation voltage to be applied to the developing sleeve 20 is −500 V.

A fog removal contrast Vback refers to a potential difference between the dark section potential VD and the DC voltage Vdc, which prevents the toner from adhering to a non-exposure portion of the photosensitive drum 1. A constant fog removal contrast Vback needs to be secured even when a developing contrast Vcont is changed.

$$Vback=|VD-Vdc|=|-700-(-500)|=200\ [V]$$

The developing contrast Vcont, which is an example of a setting condition for electrically defining the developing performance, is a potential difference between the light section potential VL and the DC voltage Vdc. Toner with a charge amount corresponding to the developing contrast Vcont adheres to the electrostatic image formed on the photosensitive drum 1. On an exposure portion of the photosensitive drum 1, negatively charged magnetic toner adheres so as to fill the developing contrast Vcont. In an image density stabilizing control, the developing contrast Vcont is adjusted so that the fixed image of the toner image obtained by developing an electrostatic image at the maximum density gray scale exhibits the maximum density.

$$Vcont=|Vdc-VL|=|-500-VL|$$

<Toner Image for Measurement>

Figure 4:
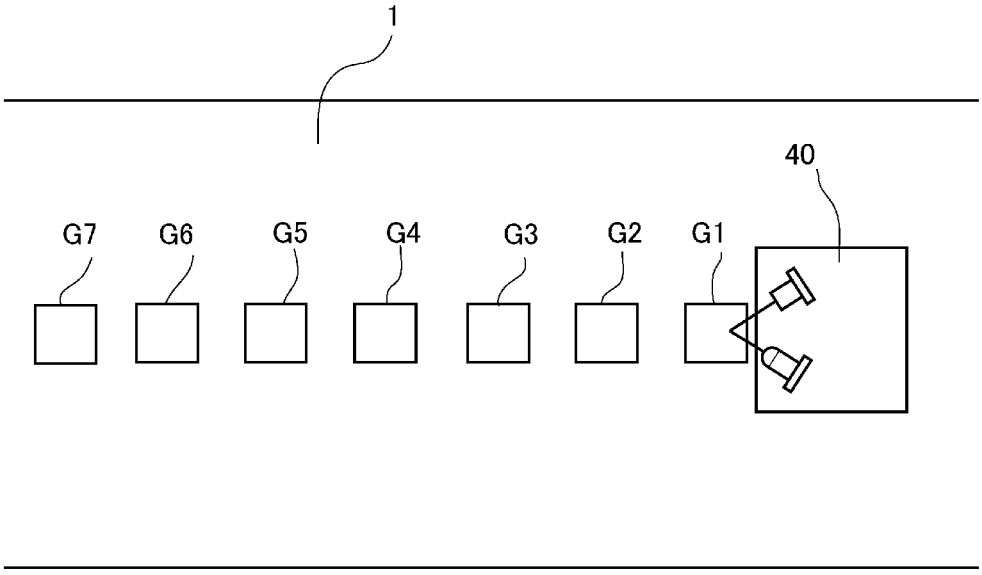
FIG. 4 is an explanatory view of toner images for measurement in an image density stabilizing control.

FIG. 4 is an explanatory view of the toner images for measurement in the image density stabilizing control. As illustrated in FIG. 1, the developing device 2 includes the developing sleeve 20 as an example of a developer carrying member configured to carry the developer, and develops the electrostatic image formed on the photosensitive drum 1 as an example of an image bearing member. The optical sensor 40 as an example of a detecting unit detects the toner bearing amount of the toner image developed by the developing device 2. The control portion 110 as an example of an executing portion executes the image density stabilizing control as an example of a setting mode at the time of non-image formation, and sets, between the developing sleeve 20 and the photosensitive drum 1, the setting condition for defining the developability of the toner image at the time of image formation.

As illustrated in FIG. 4, during the image density stabilizing control, a plurality of toner images for measurement (patch images) are continuously formed on the photosensitive drum 1. Each of the toner images for measurement is formed into a rectangle having a length of 20 mm in a scanning direction of the photosensitive drum 1, and a length of 30 mm in a rotating direction of the photosensitive drum 1.

The toner image for measurement is detected by the optical sensor 40 disposed opposite to the photosensitive drum 1. When the toner image for measurement is detected by the optical sensor 40, the recording material is not supplied, and the output of each of the transfer charger 4 and the separation charger 5 illustrated in FIG. 1 is turned OFF, to thereby allow the toner images for measurement to pass through the transfer portion T1 without being transferred.

In the optical sensor 40, an LED irradiates the surface of the photosensitive drum 1 with infrared light at an angle of 45°, to thereby detect a reflected light intensity by a photodiode disposed in a receiving position of positively reflected light. As the toner bearing amount of the toner image for measurement is larger and the amount of toner particles adhering to the surface of the photosensitive drum 1 is larger, the ratio that the incident light is scattered and absorbed increases, and thus the reflected light intensity decreases. The optical sensor 40 outputs an analog voltage signal corresponding to the detected toner bearing amount of the toner image for measurement.

The toner image for measurement formed in the image density stabilizing control for setting the maximum image density is formed under an exposure condition controlled into a predetermined area coverage modulation. The area coverage modulation to be used is a high area coverage modulation of 80% to 100%. In Embodiment 1, the toner image for measurement is formed by the area coverage modulation of 100%. When the toner image for measurement formed in the image density stabilizing control for setting the maximum image density is a halftone image, as compared to the case where the toner image for measurement has a density close to the maximum density of 100%, the image density stabilizing control can easily fluctuate the image density as a result. This is because, due to various causes of fluctuations inside the image forming apparatus 100, such as states of the photosensitive drum 1 and the developing device 2, the unevenness of the reproducibility as the toner image in each pixel exerts influence as the unevenness of the toner bearing amount measured by the optical sensor 40. Further, when the toner image for measurement formed in the image density stabilizing control for setting the maximum image density is a highlight image, control is made at a gray scale range far from the maximum density image, and hence the maximum density of the output image cannot be kept stable.

Comparative Example 1

Figure 5A:
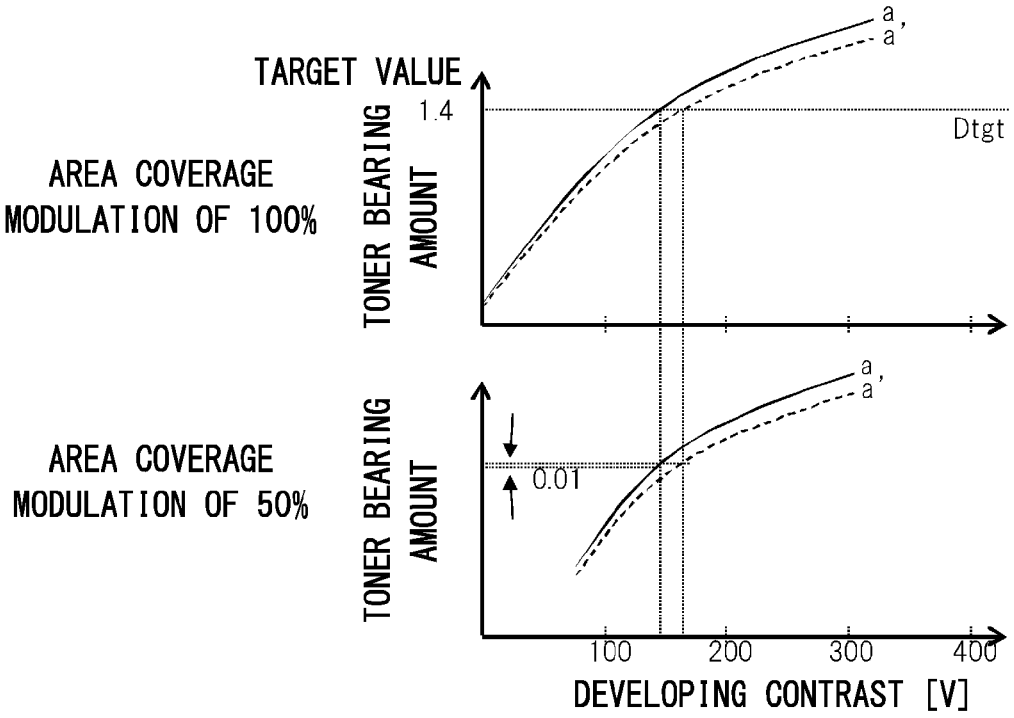
FIGS. 5A and 5B are explanatory graphs showing fluctuations in fixed image density of a medium gray scale image in Comparative Example 1.
Figure 5B:
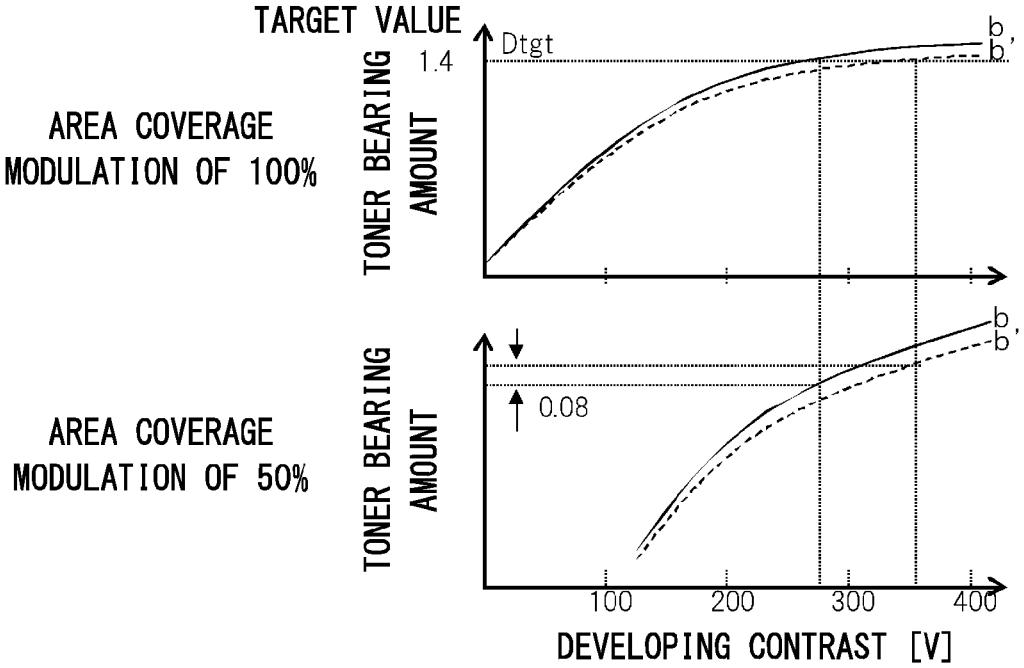

FIGS. 5A and 5B are explanatory graphs showing fluctuations in fixed image density of a medium gray scale image in Comparative Example 1. FIG. 5A is a graph showing a state in which the developing reproducibility is high. FIG. 5B is a graph showing a state in which the developing reproducibility is low.

As illustrated in FIG. 4, in the image density stabilizing control of Comparative Example 1, in order to stabilize the image density, the optical sensor 40 is used to measure the toner bearing amount of a toner image for measurement G, and based on the measurement results, a developing contrast VcontG for the image formation is set. In Comparative Example 1, there are formed toner images for measurement G1, G2, . . . , and G7 with the area coverage modulation of 100%, which have seven different levels of the developing contrast Vcont. While setting the exposure intensity (laser beam output) of the exposure device 12 constant, the charge output (dark section potential VD) from the corona charger 3 and the DC voltage Vdc to be applied to the developing sleeve 20 are set in seven different levels.

Then, based on the measurement results of the toner bearing amounts of the toner images for measurement G1, G2, . . . , and G7 with use of the optical sensor 40, the developing contrast VcontG for image formation is set so that the reflection density of the fixed image becomes a constant value of 1.4. Of the toner bearing amounts of the generated seven toner images for measurement, two points that straddle the target toner bearing amount (corresponding to the reflection density of 1.4) are selected. Through interpolation of the two points, the developing contrast at which the reflection density of the fixed image becomes 1.4 is obtained. The DC voltage Vdc to achieve the obtained developing contrast is set to the power supply D2 for the developing device 2, and in addition, the output of the corona charger 3 is set so that the DC voltage of Vdc+200 V (fog removal contrast Vback) can be obtained.

As shown in FIG. 3, the developing contrast Vcont can be adjusted even when the exposure output of the exposure device 12 is varied, and hence the dark section potential VD and the DC voltage Vdc may be fixed, and the exposure output of the exposure device 12 may be changed into seven levels to form the toner images for measurement. Similarly to the case where the dark section potential VD or the DC voltage Vdc is changed, the exposure output is set so as to obtain the developing contrast corresponding to a certain target toner bearing amount.

As shown in FIGS. 5A and 5B, from the measurement results of the toner bearing amounts of the seven types of the toner images for measurement having different developing contrasts, one curve of (toner bearing amount)/(developing contrast) can be obtained. FIGS. 5A and 5B show both a state "a" in which the developer is nearly new and has high developing performance, and a state "b" in which the developer is used for a long time and has a low developing performance. The solid lines "a" and "b" represent the respective states at a certain time, and the broken lines a' and b' represent respective states in which the developer has deteriorated from the above-mentioned states because the user performed image formation with low image rate. The toner bearing amount and the reflection density of the fixed image have a substantially linear relationship, and hence the toner bearing amount is represented in terms of the reflection density of the fixed image for the sake of easy understanding of the description.

In the image density stabilizing control of Comparative Example 1, with use of the toner image for measurement of the area coverage modulation of 80% to 100%, the developing contrast for image formation is set so as to achieve a constant target toner bearing amount. As a result, before and after the image density stabilizing control, the fixed image density of the halftone image may significantly change.

As shown in FIG. 5A, the developing contrast of the solid line "a" representing the case of high developing performance is determined to 140 V, while the developing contrast of the broken line a' is determined to 160 V. In this case, the density change of the halftone image is 0.01, which is satisfactory.

However, as shown in FIG. 5B, the developing contrast of the solid line "b" representing the case of low developing performance is determined to 280 V, while the developing contrast of the broken line b' is determined to 350 V. As described above, in a case where the density at which the maximum density image is saturated in density is close to the target density when the developing contrast is changed, the developing contrast to be set significantly varies due to the slight difference in developing performance. However, the halftone image is not saturated in density in a region of that developing contrast, and hence the density change is large as 0.08.

Comparative Example 2

Figure 6A:
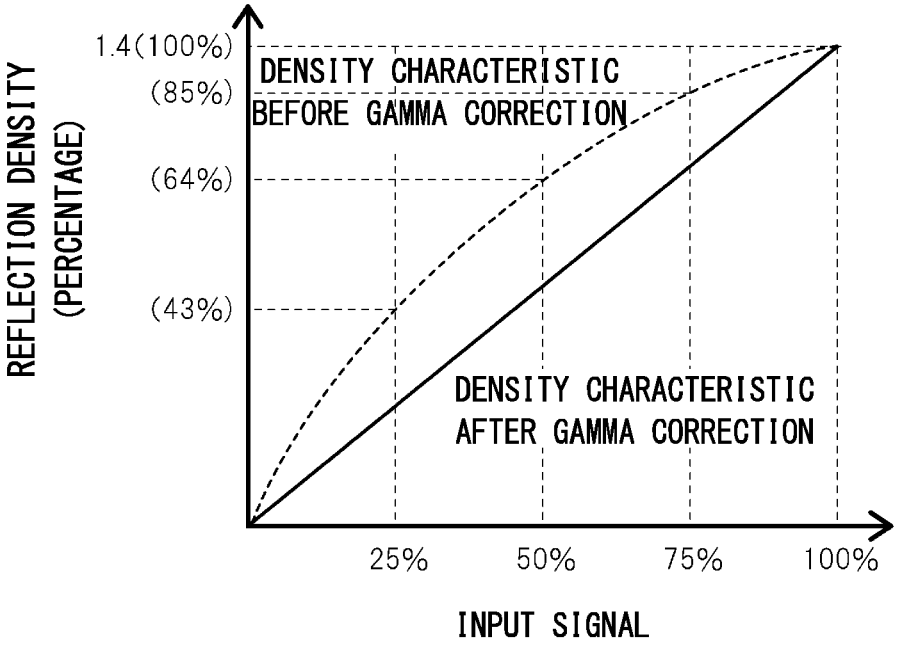
FIGS. 6A and 6B are explanatory graphs of an image density stabilizing control in Comparative Example 2.
Figure 6B:
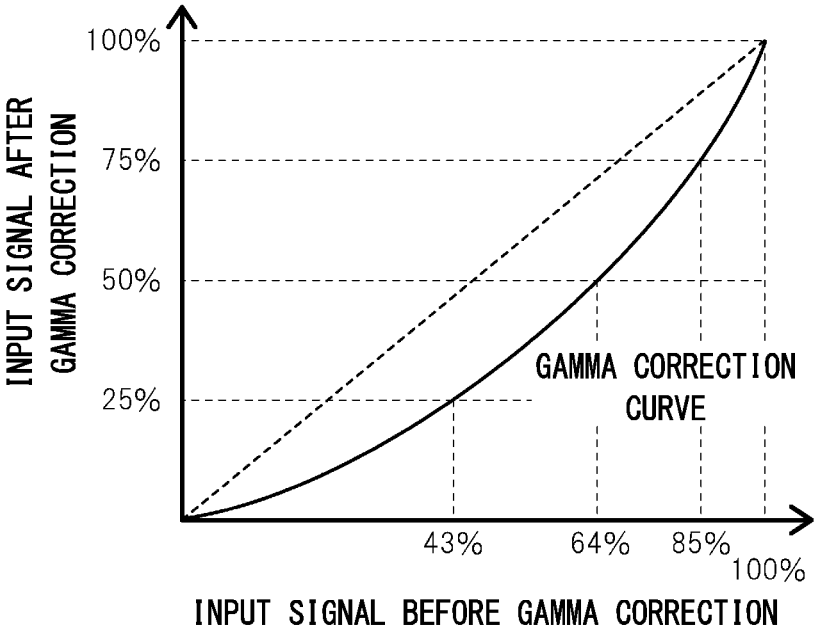

FIGS. 6A and 6B are explanatory graphs of an image density stabilizing control in Comparative Example 2. FIG. 6A is a graph showing the reflection density characteristic before and after a gamma correction. FIG. 6B is a graph showing the gamma correction. In Comparative Example 2, through so-called gamma correction, the quality that satisfies the user is maintained also in the maximum density, and further the halftone density is more stabilized.

In the gamma correction set by manual operation performed in the initial setting, the toner bearing amount is determined by the developing contrast with the method of Comparative Example 1. Then, ten levels of the toner images for measurement of the area coverage modulation of 10% to 100% are formed, and the toner images for measurement are transferred onto the recording material and fixed by the fixing device. Then, the reflection densities of the recording material and the ten fixed images of the toner images for measurement on the recording material are measured, and gray scale conversion is performed so that the image density at each area coverage modulation becomes a defined value.

In Comparative Example 2, such an operation and processing are performed by measuring the toner bearing amount with use of the optical sensor 40. While securing the reproducibility at the maximum density by the image density stabilizing control of Comparative Example 1, the ten levels of the toner images for measurement of the area coverage modulation of 10% to 100% are formed, and the toner bearing amount of each of the toner images for measurement is measured by the optical sensor 40. Then, as shown in FIGS. 5A and 5B, a gray scale conversion table for the image signal is formed so that the toner bearing amounts of the ten levels of the toner images for measurement of the area coverage modulation of 10% to 100% each becomes the defined value at the corresponding area coverage modulation of 10% to 100%.

In Comparative Example 2, the gamma correction control is performed every time the maximum image density is set. Therefore, the maximum density and the medium density can be more stabilized, but a long down-time is required to perform the full setting, and hence the apparent productivity of the image forming apparatus is reduced. Further, the output of the optical sensor 40 regarding the toner image for measurement instead of the reflection density of the fixed image is used, and hence a toner image for measurement of a low area coverage modulation is affected by, for example, the sectional shape of the toner image as described later (see FIG. 12). As a result, an error occurs in the level of the reflection density of the fixed image.

Embodiment 1

Figure 7:
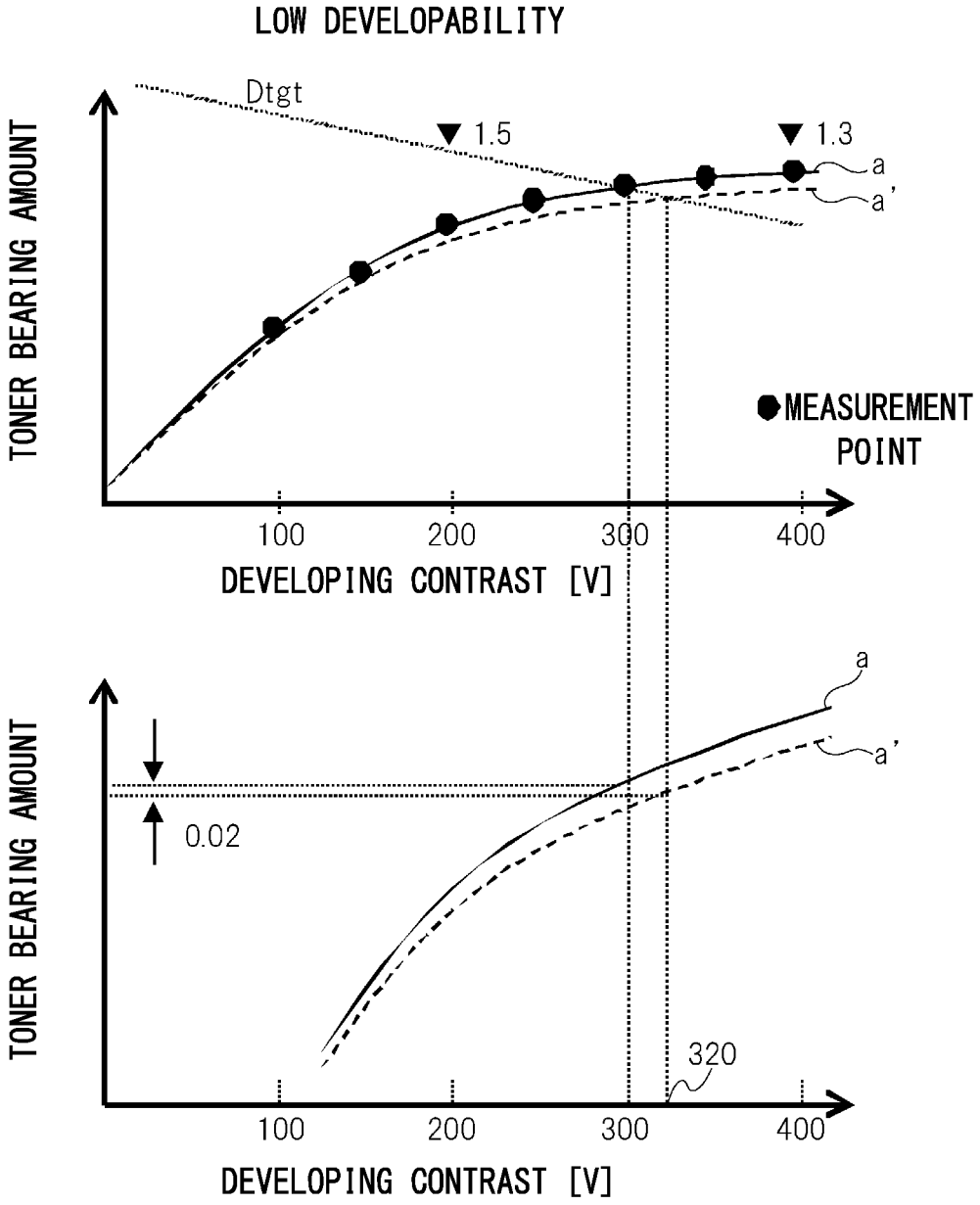
FIG. 7 is an explanatory graph of an image density stabilizing control for setting the maximum image density in Embodiment 1.
Figure 8A:
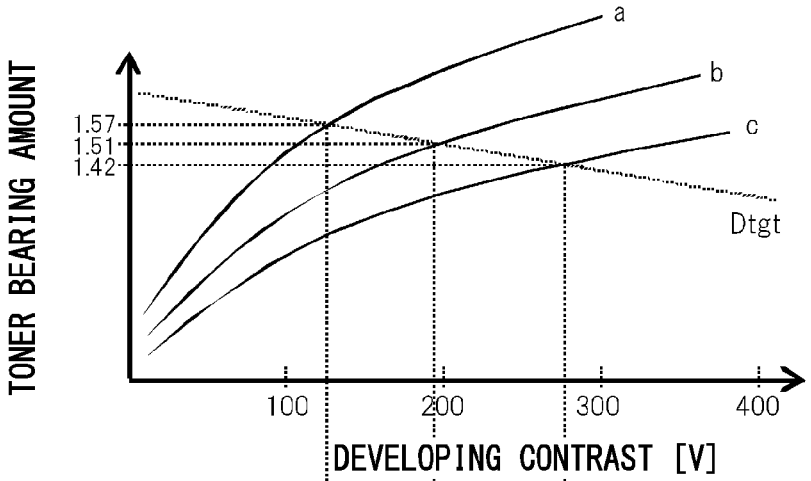
FIGS. 8A and 8B are explanatory graphs showing the relationship between a developing contrast and a target toner bearing amount.
Figure 8B:
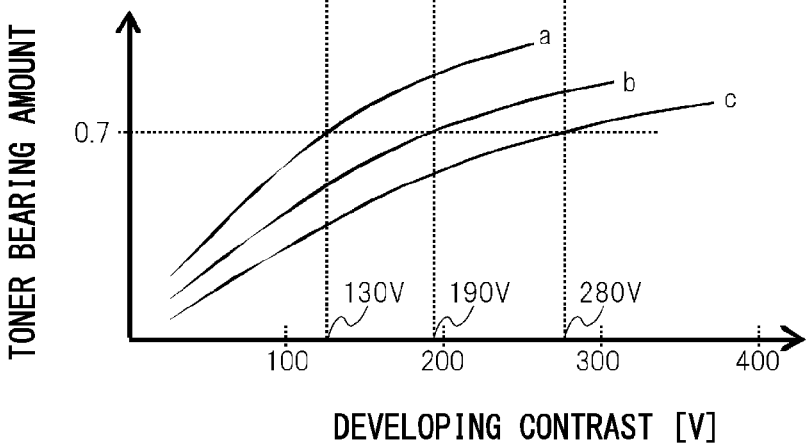
Figure 9:
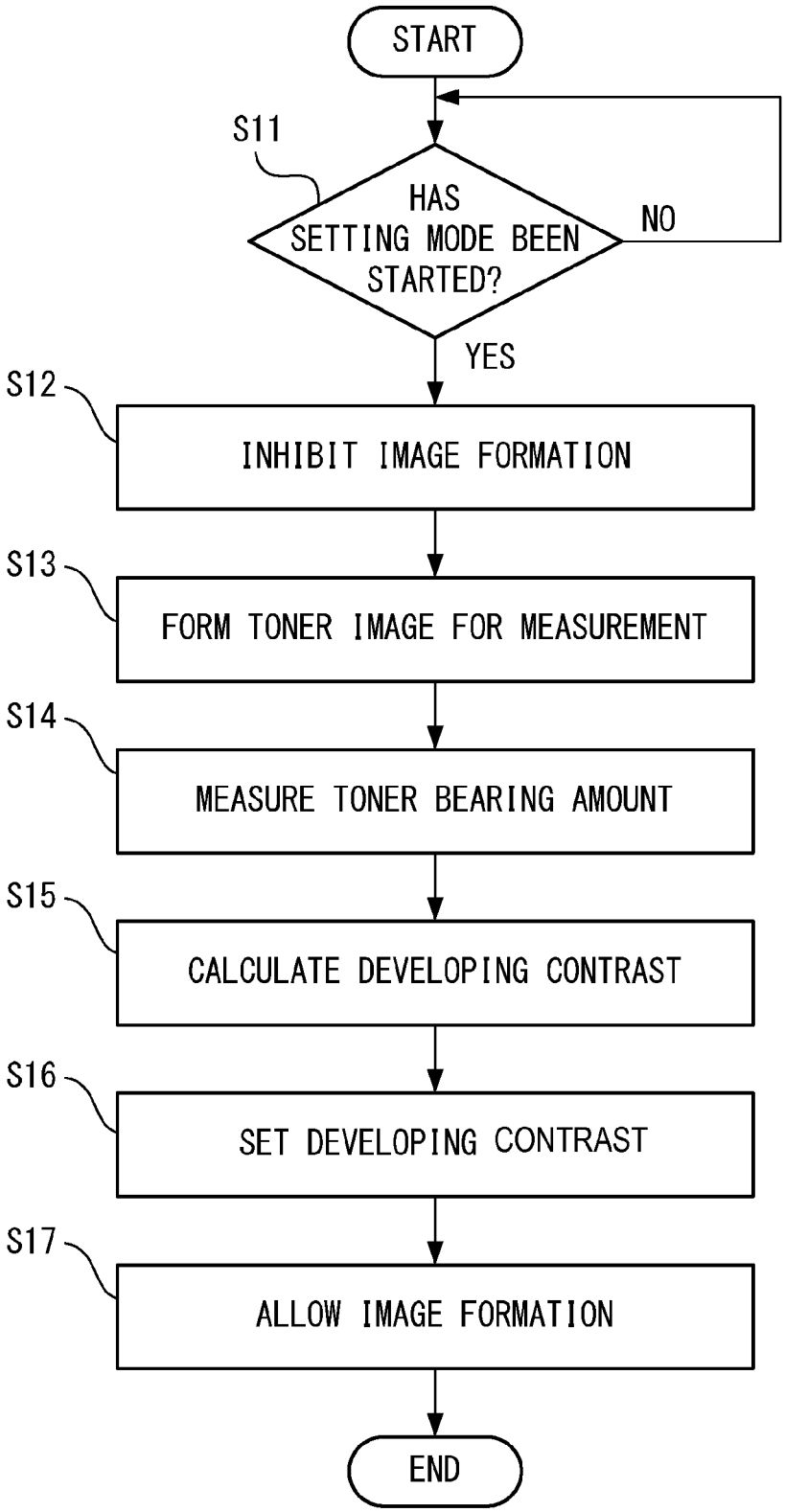
FIG. 9 is a flowchart of the image density stabilizing control of Embodiment 1.

FIG. 7 is an explanatory graph of an image density stabilizing control for setting the maximum image density in Embodiment 1. FIGS. 8A and 8B are explanatory graphs showing the relationship between the developing contrast and the target toner bearing amount. FIG. 9 is a flowchart of the image density stabilizing control of Embodiment 1.

As illustrated in FIG. 1, the control portion 110 as an example of a setting portion sets the target value so that the setting condition set in the setting mode includes at least a region in which the target value reduces in a case where setting is performed from a low developability condition to a high developability condition. In the setting mode, the toner image for measurement of the area coverage modulation of 90% or more is formed on the photosensitive drum 1, and the setting condition defining the developability of the toner image is set so that the detection result obtained when the toner image for measurement is detected by the optical sensor 40 becomes the target value set in advance.

In the image density stabilizing control for setting the maximum image density of Embodiment 1, the developing contrast as an example of a setting condition for a developing electric field to be formed between the developer carrying member and the image bearing member at the time of image formation is controlled. The developing contrast is controlled so that, when the value of the developing contrast is at least within a predetermined range, as the setting condition transits from the lower side to the higher side in developability, the target value of the maximum image density is reduced. That is, the target value of the maximum image density is stored in the apparatus main body in advance so that, when the developing contrast is at least within a predetermined range, the maximum image density is reduced as the developing contrast increases.

The method of setting the target value of the maximum image density to be set in the apparatus main body in advance will be described later. In the present invention, the target value (target density Dtgt) stored in the main body is obtained and set through experiments etc. in advance so that an image having half of the maximum image density formed after the setting condition is set in the setting mode has a color difference ΔE of 6.5 or less with respect to an image having half of the maximum image density formed after the setting condition is set in the setting mode with use of unused developer. Further, the target value stored in the main body is obtained and set through experiments etc. in advance so that the maximum density image formed after the setting condition is set in the setting mode has a color difference ΔE of 6.5 or less with respect to the maximum density image formed after the setting condition is set in the setting mode with use of unused developer.

The target value is set so that a difference in reflection density between the fixed image of an image of the area coverage modulation of 50%, which is formed after the setting condition is set in the setting mode, and the fixed image of an image of the area coverage modulation of 50%, which is formed after the setting condition is set in the setting mode with use of unused developer, is 0.05 or less. The target value is set so that a difference in toner bearing amount between images of the area coverage modulation of 50%, which are formed before and after the setting mode is executed, is smaller than a difference in toner bearing amount between images of the area coverage modulation of 100%, which are formed before and after the setting mode is executed.

As illustrated in FIG. 4, in the image density stabilizing control of Embodiment 1, a constant electrostatic image is formed with an exposure pattern at the area coverage modulation of 100%, and the developing contrast Vcont is changed in seven levels to generate seven types of the toner images for measurement. By changing the dark section potential VD and the DC voltage Vdc in seven levels while maintaining the fog removal contrast Vback to 200 V, the developing contrast Vcont is changed in seven levels in increments of 50 V in a range of 100 V to 400 V. At each of the seven levels of the developing contrast Vcont (100 V to 400 V), the toner images for measurement are generated, and the toner bearing amount thereof is measured by the optical sensor 40.

As shown in FIG. 7, the seven level values of (toner bearing amount)/(developing contrast Vcont) indicated by black circles are connected, and a curve of (toner bearing amount)/(developing contrast) when the image density stabilizing control is executed is calculated. The curve of (toner bearing amount)/(developing contrast Vcont) at a certain state of the developer is represented by the solid line "a". The curve of (toner bearing amount)/(developing contrast Vcont) in a state in which, from the above-mentioned state, the developer has deteriorated and the developing performance has slightly reduced because the user continued to output an image with low image rate is represented by the broken line a'. The seven dots of the measured toner bearing amounts are represented only on the solid line "a". The function Dtgt of the target toner bearing amount is defined by the straight line obtained by connecting the point of the reflection density of 1.5 at the developing contrast Vcont of 200 V and the point of the reflection density of 1.3 at the developing contrast Vcont of 400 V. The function Dtgt is experimentally obtained in advance to be formed into a table.

Details of the method of setting the target value of the maximum image density that is stored in the apparatus main body will be described below. First, FIG. 8A shows the developing characteristic (characteristic of toner bearing amount with respect to developing contrast) when an image of the area coverage modulation of 100% is developed with use of developer having different usage duration state. That is, FIG. 8A shows the results of measurement of the density of the image of the area coverage modulation of 100% by changing the developing contrast into seven levels. The curve "a" of the graph of FIG. 8A represents the developing characteristic in a state in which the developer is new. The curve "c" of the graph represents the developing characteristic of the developer in a state in which the end-of-life developing device 2 is used. The curve "b" of the graph represents the developing characteristic measured in a state in which the duration state of the developer is in an intermediate state between the states of the curves "a" and "b".

FIG. 8B shows the developing characteristic of the halftone image of the area coverage modulation of 50% measured by a method similar to that of FIG. 8A. The curve "a" of the graph represents the developing characteristic in a state in which the developer is new. The curve "c" of the graph for the area coverage modulation of 50% is obtained by executing the similar operation in a state in which the end-of-life developing device 2 is used and measuring the developing characteristic. The curve "b" of the graph for the area coverage modulation of 50% is obtained by executing the similar operation in an intermediate state between the states of the curves "a" and "c" and measuring the developing characteristic.

As shown in FIG. 8B, in a state in which the developer is new (curve "a"), the developing contrast Vcont at which the reflection density of the fixed image of the toner image of the area coverage modulation of 50% becomes 0.7 is 130 V. Further, as shown in FIG. 8A, in the state in which the developer is new, the toner bearing amount at the time of the obtained developing contrast of 130 V is 1.57 in terms of the reflection density.

As shown in FIG. 8B, in a state in which the end-of-life developing device 2 is used (curve "c"), the developing contrast Vcont at which the reflection density of the fixed image of the toner image of the area coverage modulation of 50% becomes 0.7 is 280 V. Further, as shown in FIG. 8A, in the state in which the end-of-life developing device 2 is used (curve "c"), the toner bearing amount at the time of the obtained developing contrast of 280 V is 1.42 in terms of the reflection density.

As shown in FIG. 8B, under an intermediate state between the states of the curves "a" and "c" (curve "b"), the developing contrast Vcont at which the reflection density of the fixed image of the toner image of the area coverage modulation of 50% becomes 0.7 is 190 V. Further, as shown in FIG. 8A, under the intermediate state between the states of the curves "a" and "c" (curve "b"), the toner bearing amount at the time of the obtained developing contrast of 190 V is 1.51 in terms of the reflection density.

Therefore, in order to obtain the reflection density of 0.7 in the fixed image of the toner image in the curve "a" for the area coverage modulation of 50%, in the curve "a" for the area coverage modulation of 100%, the target toner bearing amount may be set to a value corresponding to the fixed image reflection density of 1.57. In order to obtain the reflection density of 0.7 in the fixed image of the toner image in the curve "c" for the area coverage modulation of 50%, in the curve "c" for the area coverage modulation of 100%, the target toner bearing amount may be set to a value corresponding to the reflection density of 1.42. In order to obtain the reflection density of 0.7 in the fixed image of the toner image in the curve "b" for the area coverage modulation of 50%, in the curve "b" for the area coverage modulation of 100%, the target toner bearing amount may be set to a value corresponding to the reflection density of 1.51.

As described above, in the present invention, at the time of experiment, as shown in FIG. 8A, the developing characteristic of the image having the maximum image density or the density close to the maximum image density is measured for each duration situation of the developer (curves "a" to "c"). Further, as shown in FIG. 8B, the developing characteristic of the halftone image is measured for each duration situation of the developer (curves "a" to "c"). Then, such a developing contrast that the density of the halftone image is constant regardless of the developer duration situation is obtained from FIG. 8B, and, based on the developing contrast obtained for each duration situation of the developer, the toner bearing amount when the image of the area coverage modulation of 100% is formed is obtained from the results of FIG. 8A. The toner bearing amount thus obtained is stored in the apparatus main body as the target value at the time of the image density stabilizing control for setting the maximum image density.

Note that, when the target density is set at the time of experiment, it is desired that various unevenness factors do not enter the main body side of the image forming apparatus 100 as much as possible. In order to remove such unevenness factors, when the target value is obtained for use in the image density stabilizing control, three toner images for measurement are output for each one developing contrast to be set for the toner image for measurement. Then, the toner bearing amount is measured at six points in one toner image for measurement, and eighteen (3×6) measured values of the toner bearing amount are averaged to be used.

Therefore, in Embodiment 1, the function Dtgt of the target toner bearing amount is set as a straight line passing through the three points obtained as described above (1.57 at 130 V, 1.51 at 190 V, and 1.42 at 280 V). The developing contrast Vcont of the image forming apparatus 100 is set in the range of 100 V to 400 V. The target density Dtgt is a function passing through the point of the reflection density of 1.6 at Vcont=100 V, the point of the reflection density of 1.45 at Vcont=250 V at the center, and the point of the reflection density of 1.3 at Vcont=400 V at the maximum.

In Embodiment 1, in a range in which the developing contrast condition may be used, the change amount of the reflection density of the fixed image is suppressed to a range that satisfies the user. The slope of the function of the target density Dtgt is set so as to satisfy the relationship of $\Delta E \leq 3.2$ with respect to the center reflection density of 1.45. Even if the reflection density of the halftone image is not constant, when the range of $\Delta E \leq 3.2$ is substantially satisfied, the image may be generally sensed as the same color in the human eyes. Even if the density of the halftone image is not constant, in the range of $\Delta E \leq 6.5$, the image can be handled as the same color in at least the impression level.

As illustrated in FIG. 9 referring to FIG. 1, at the executing timing of the image density stabilizing control (YES of S11), the control portion 110 inhibits the image formation (S12). As shown in FIG. 4, the control portion 110 forms the toner images for measurement having different developing contrasts Vcont (S13), and the optical sensor 40 measures the toner bearing amount (S14).

The control portion 110 uses the seven obtained items of data of (toner bearing amount)/(developing contrast Vcont) and the function Dtgt shown in FIG. 7 to obtain the target toner bearing amount at which the reflection density of the fixed image of the toner image of the area coverage modulation of 50% becomes 0.7. As shown in FIGS. 6A and 6B, the control portion 110 determines the presence/absence of the intersection between the interpolation straight line and the function Dtgt shown in FIG. 7 for all of the combinations of the two adjacent items of data of (toner bearing amount)/(developing contrast Vcont). Then, the target value of (toner bearing amount)/(developing contrast Vcont) corresponding to the intersection is calculated (S15).

In order to obtain the developing contrast Vcont that can obtain the target toner bearing amount defined by the function Dtgt shown in FIG. 7, the control portion 110 sets the output of the corona charger 3 and the DC voltage to be applied to the developing sleeve 20 of the image forming apparatus 100 (S16).

The control portion 110 allows the image formation (S17), and the image density stabilizing control is ended.

As shown in FIG. 7, the image density stabilizing control for setting the developing contrast Vcont to match with the function Dtgt set in advance was executed in the image forming apparatus 100. Then, the developing contrast Vcont was determined to 300 V in the case of the curve "a", and the developing contrast Vcont was determined to 320 V in the case of the curve a' in which the developer is slightly deteriorated from the case of the curve "a".

As a result, the difference in halftone density between the curves "a" and a' is suppressed to 0.02, while including other fluctuations. As compared to Comparative Example 1 shown in FIG. 5B, very satisfactory reproducibility of the reflection density of the fixed image was obtained. Further, the density difference at the maximum density section of the image caused by the shift of the target toner bearing amount was 0.02, which was not a great change.

With the image density stabilizing control of Embodiment 1, while maintaining the maximum density at a quality that satisfies the user, the halftone density can be more stabilized.

In Embodiment 1, a case using a monochrome image forming apparatus in which the optical sensor is opposed to the photosensitive drum is described. However, in a full-color image forming apparatus of four colors, which includes an intermediate transfer belt, the optical sensor may be arranged opposed to the intermediate transfer belt.

Note that, in Embodiment 1, the correction of the medium density through image processing (γLUT) is performed only when the power is turned ON. That is, when the power is turned ON, both of the control by the developing contrast with use of the toner image for measurement having almost the maximum density (image density stabilizing control for the maximum image density), and the correction of the medium density through image processing (γLUT) are performed. On the other hand, during use thereafter, as described in this Embodiment, the image density stabilizing control for setting the maximum image density while considering the halftone density is performed.

With this, while reducing the down-time during usage by the user as much as possible, the change in the maximum density and in the halftone density can be suppressed to a predetermined value or less. Specifically, when the user turns the power ON every morning, the two controls using the developing contrast and γLUT are performed, and after that, at the frequency of once in passage of 1,000 sheets of A4-sized recording materials, merely the control using the developing contrast is performed. With this, as compared to the case where both the controls are performed for every 1,000 sheets, time taken for control is decreased by half.

Embodiment 2

Figure 10:
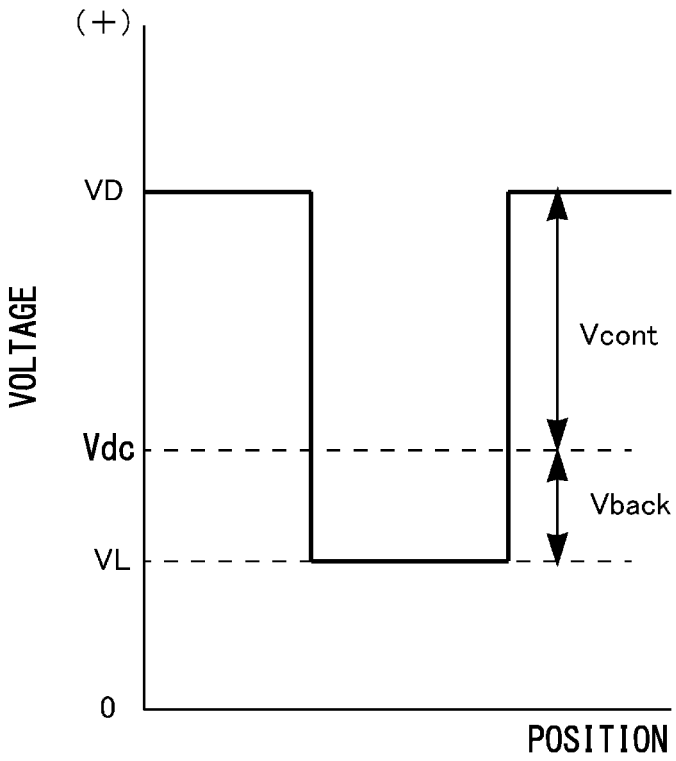
FIG. 10 is an explanatory graph of a developing characteristic in a charged area development.
Figure 11:
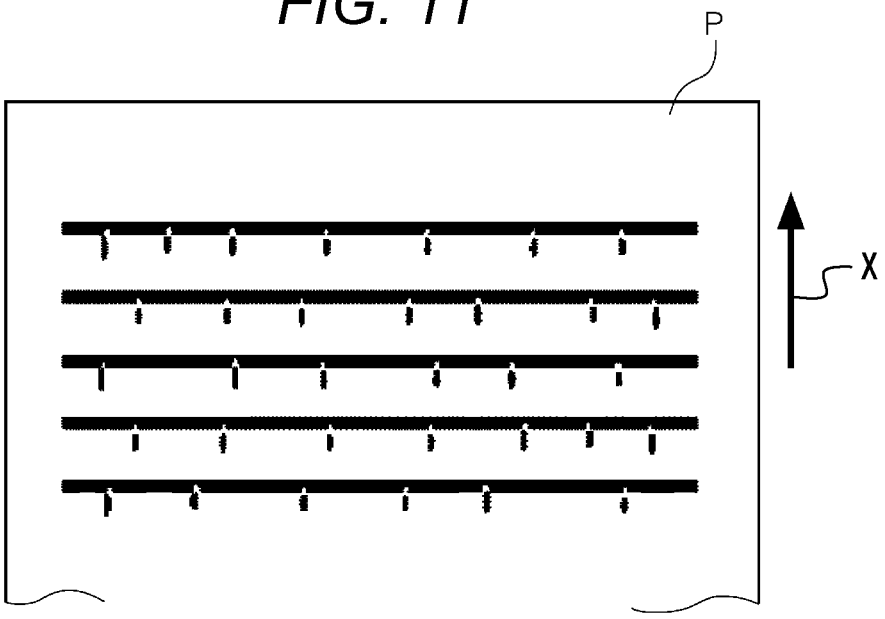
FIG. 11 is an explanatory view of a bleeding image phenomenon.
Figure 12:
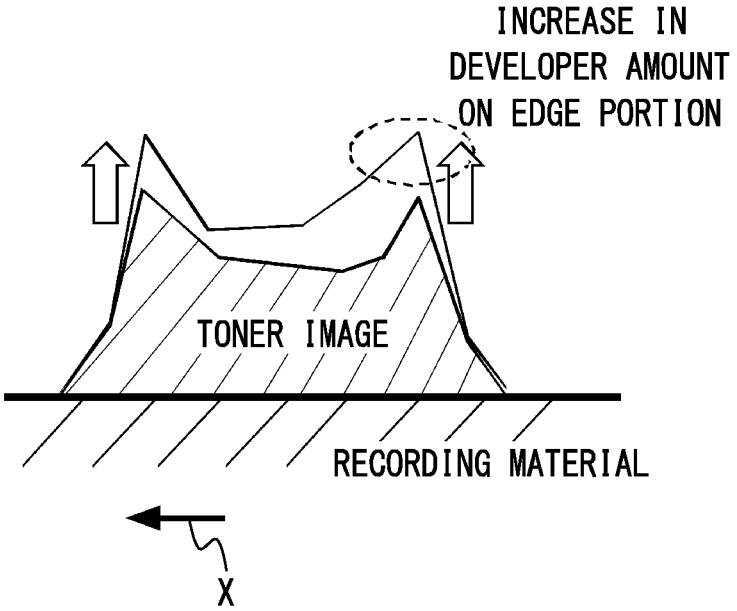
FIG. 12 is a sectional view of a toner image extending along a main scanning line taken along a sub-scanning direction.
Figure 13A:
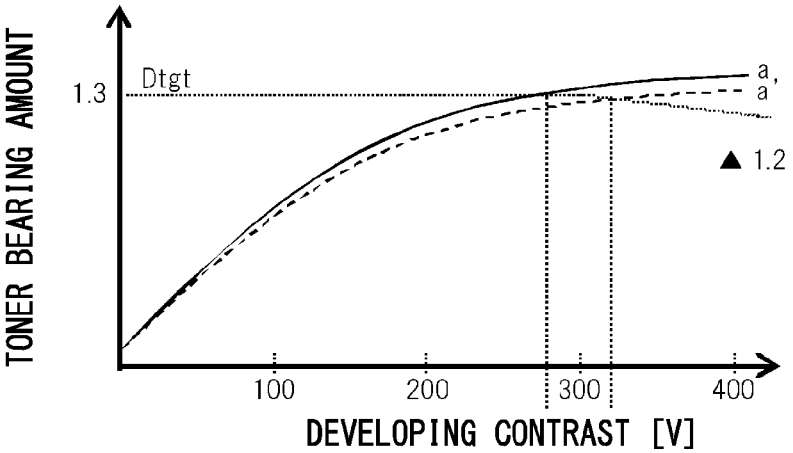
FIGS. 13A and 13B are explanatory graphs of an image density stabilizing control for setting the maximum image density in Embodiment 2.
Figure 13B:
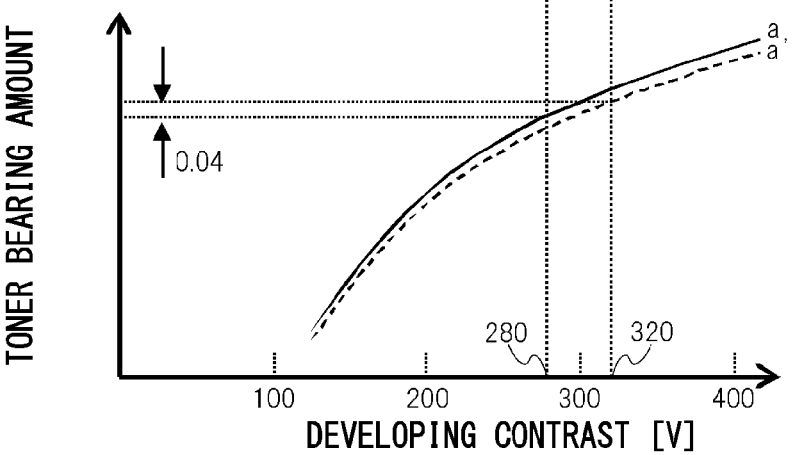

FIG. 10 is an explanatory graph showing the developing characteristic in a charged area development. FIG. 11 is an explanatory view of a bleeding image phenomenon. FIG. 12 is a sectional view of a toner image in a sub-scanning direction taken along a main scanning line. FIGS. 13A and 13B are explanatory graphs of an image density stabilizing control for setting the maximum image density in Embodiment 2.

In Embodiment 1, as shown in FIG. 7, the linearly-sloped function Dtgt is applied in the entire range of the developing contrast of 0 V to 400 V. In contrast, in Embodiment 2, the application range of the linearly-sloped function Dtgt is limited to the range of the developing contrast of 300 V to 400 V. In the range of the developing contrast of 0 V to 300 V, similarly to Comparative Example 1, the target toner bearing amount was set at a constant value (corresponding to 1.3 in terms of the reflection density of the fixed image). This is for preventing an excessive developing contrast Vcont from being set in a region in which the developer is not much deteriorated. Therefore, in the following, the region in which the function Dtgt is not sloped will be described. A redundant description to that in Embodiment 1 relating to the region in which the function Dtgt is sloped is omitted.

In other words, in a range of the value of the setting condition in which the developability becomes higher with respect to the developing contrast of 300 V, which is an example of a predetermined value of the setting condition, the target value is set lower than that in a range of the value of the setting condition in which the developability becomes lower with respect to the predetermined value. In the range of the value of the setting condition in which the developability becomes lower with respect to the developing contrast of 300 V, a constant target value is set. In the range of the value of the setting condition in which the developability becomes higher with respect to the developing contrast of 300 V, the target value is set lower as the setting condition transits from the lower side to the higher side in developability.

That is, in a range in which the developing performance of the developer is high and the toner can sufficiently fill the developing contrast of the electrostatic image of the area coverage modulation of 100%, the developing contrast is set so that the toner bearing amount becomes a certain target value as in the conventional case. This is because, when the developing performance of the developer is high, the toner bearing amount can be reproduced equally in both of the cases of the area coverage modulation of 100% and 50% even without decreasing the target value.

Then, when the developing performance of the developer decreases and the toner cannot sufficiently fill the developing contrast of the electrostatic image of the area coverage modulation of 100%, the developing contrast is set by lowering the target value of the toner bearing amount of the toner image for measurement of the area coverage modulation of almost 100%. This is because, even when the developing performance of the developer decreases, the rate that the charges of the toner filling the developing contrast does not decrease so much in the electrostatic image of the area coverage modulation of 50% as compared with the electrostatic image of the area coverage modulation of 100%.

As illustrated in FIG. 1, negatively charged toner is used also in Embodiment 2. The photosensitive drum 1 is positively chargeable and is made of a-Si, which is excellent in duration performance.

As shown in FIG. 10, the corona charger 3 charges the surface of the photosensitive drum 1 at the dark section potential VD of 700 V. In the image density stabilizing control, the output of the corona charger 3 is changed to change the exposed light section potential VL in increments of 50 V from 100 V to 400 V. In addition, the DC voltage Vdc is changed in increments of 50 V from 300 V to 600 V so that the fog removal contrast Vback, which is the potential difference between the DC voltage Vdc to be applied to the developing sleeve 20 and the light section potential VL, becomes 200 V.

$$V\text{back}=VL-\text{Vdc}=200\ [\text{V}]$$

The developing contrast Vcont corresponds to the potential difference between the dark section potential VD and the DC voltage Vdc, and toner with a charge amount corresponding to the developing contrast Vcont adheres to the electrostatic image formed on the photosensitive drum 1. On a non-exposure portion of the photosensitive drum 1, negatively charged magnetic toner adheres so as to fill the developing contrast Vcont.

$$V\text{cont}=VD-\text{Vdc}$$

In the optical sensor 40 employed in Embodiment 2, with respect to the toner image having the toner bearing amount corresponding to 1.4 or more in terms of the reflection density of the fixed image, the detection value of the toner bearing amount is saturated, and the detection accuracy of the difference in toner bearing amount degrades. Therefore, in Embodiment 2, the electrostatic image for measurement is generated by an exposure pattern at the area coverage modulation of 90%, which is intentionally somewhat lowered.

As illustrated in FIG. 11, in the image forming apparatus 100 employed in Embodiment 2, when a thin line image has too much toner bearing amount (1.4 or more in terms of the reflection density of the fixed image), there occurs a phenomenon that the transverse line formed in the main scanning direction bleeds from its trailing edge in a conveyance direction X and is transferred in this state. This is called a bleeding image phenomenon.

As illustrated in FIG. 12 corresponding to a sectional view of the line image, a phenomenon that the developer amount borne on the edge portion in the line image increases becomes remarkable, and the developer at the edge portion easily falls backward in the conveyance direction X at the transfer portion. In the image forming apparatus 100, when the toner bearing amount of the toner image exceeds that corresponding to 1.45 or more in terms of the reflection density at the maximum density portion, the phenomenon that the transverse line formed in the main scanning direction bleeds from its trailing edge in the conveyance direction X starts to occur.

Therefore, in Embodiment 2, in order to prevent the developing contrast from being set to such a developing contrast corresponding to 1.3 or more in terms of the reflection density of the fixed image of the pattern for measurement of the area coverage modulation of 90%, in the range of the developing contrast of 300 V or less, the target toner bearing amount is fixed to a value corresponding to 1.3 in terms of the reflection density of the fixed image. With this, in a period in which the developer is not much deteriorated, the reflection density of the fixed image of the toner image formed in accordance with the target toner bearing amount is prevented from exceeding 1.3.

FIG. 13A is a graph showing the case where the area coverage modulation is 90%. As shown in FIG. 13A, until the developing contrast to be set is 300 V, the target toner bearing amount (target density) of the toner image for measurement is set to a value corresponding to 1.3 in terms of the reflection density of the fixed image of the toner image for measurement. When (developing contrast Vcont)≤300 V is satisfied, the target density Dtgt in the patch image of 90% is set to 1.3 so that the reflection density of the fixed image at the maximum density becomes 1.45 or less.

In the range in which the developing contrast is 300 V to 400 V, the target toner bearing amount is set in a manner that the above-mentioned two points are connected. The slope of the target density Dtgt in the range of 300 V<Vcont<400 V is obtained so that the reflection density of the fixed halftone image of the area coverage modulation of 50% becomes constant as shown in FIG. 8B. Note that, in Embodiment 2, the dark section potential VD is set constant while the exposure output is changed to change the light section potential VL and the DC voltage Vdc. As a result, when the developing contrast to be set is 400 V, the target toner bearing amount is set so as to have a value corresponding to 1.2 in terms of the reflection density of the fixed image of the toner image for measurement.

Based on the target density Dtgt thus obtained, in the case of the solid line "a" in which the developer is not much deteriorated, the developing contrast for performing image formation is set to 280 V. In the case of the broken line a' in which the developer has deteriorated, the developing contrast for performing image formation is set to 320 V.

FIG. 13B is a graph showing the case where the area coverage modulation is 50%. As shown in FIG. 13B, in Embodiment 2, the density change between the solid line "a" and the broken line a' in the halftone image of the area coverage modulation of 50% was 0.04, and the reproducibility was obtained while hardly changing the density. Further, as shown in FIG. 13A, the density change at the maximum density of the area coverage modulation of 90% was 0.01, and thus the density hardly changed. Further, the phenomenon that the line image bleeds from its trailing edge in the main scanning direction did not occur.

Embodiment 3

Figure 14A:
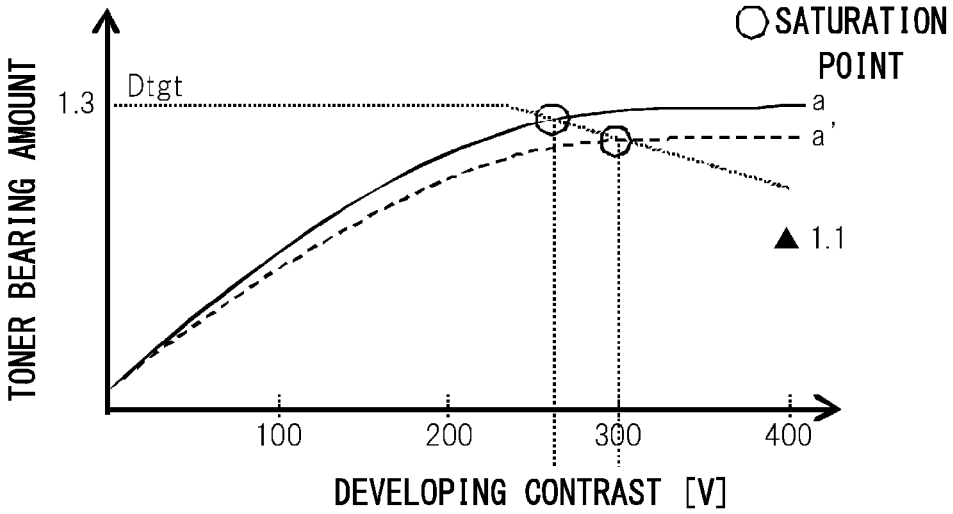
FIGS. 14A and 14B are explanatory graphs of an image density stabilizing control for setting the maximum image density in Embodiment 3.
Figure 14B:
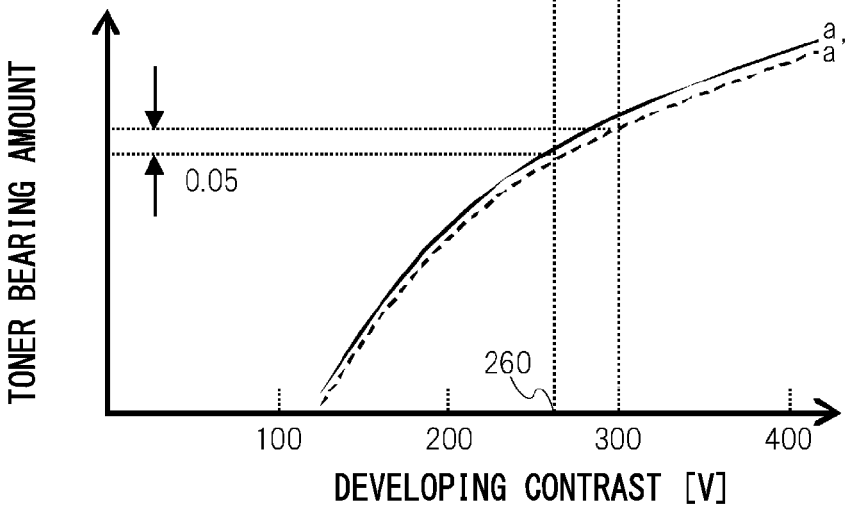

FIGS. 14A and 14B are explanatory graphs of an image density stabilizing control for setting the maximum image density in Embodiment 3. In Embodiment 3, the slope of the target density Dtgt is set in consideration of the bleeding image phenomenon. In Embodiment 3, other points that are not particularly described are the same as those in Embodiment 2.

In Embodiment 2, the fact that, in the image forming apparatus 100, the bleeding image phenomenon in the sub-scanning direction occurs in the line image extending in the main scanning direction when the reflection density of the fixed image at the maximum density becomes 1.45 or more has been described. However, in the actual case, in the image forming apparatus 100, the bleeding image phenomenon is liable to occur when the developer has deteriorated even if the reflection density of the fixed image at the maximum density is less than 1.45. When the deterioration of the developer progresses, etc., and the developing contrast is taken larger than the developing contrast at which the curve of the toner bearing amount with respect to the developing contrast is saturated, the bleeding image phenomenon is liable to occur.

The reason is as follows. As illustrated in FIG. 12, in those cases, the phenomenon that the developer amount borne on the edge portion in the cross section of the line image increases becomes remarkable, and the developer swelled at the edge portion in the cross section of the line image easily falls backward in the sub-scanning direction (conveyance direction X) at the transfer portion.

In this case, when the developing contrast is determined from the viewpoint of merely the bleeding image phenomenon, the slope of the function of the target density Dtgt is only required to be set so as to fall more steeply as compared with Embodiment 2. However, when the function of the target density Dtgt is sloped too steeply, the density of the halftone image becomes lower than necessary. Therefore, in Embodiment 3, as shown in FIG. 14A, the slope of the function of the target density Dtgt is determined considering also the stability of the density of the halftone image.

In Embodiment 3, the slope of the function of the target density Dtgt is set so as to satisfy a narrower range of substantially $\Delta E \leq 3.2$ in which, even when the reflection density of the fixed image of the halftone image is not constant, the image can be generally sensed as the same color in the human eyes. This is because, even if the density of the halftone image is not constant, in the range of $\Delta E \leq 6.5$, the image can be handled as the same color in at least the impression level.

FIG. 14A is a graph showing the case where the area coverage modulation is 90%. FIG. 14B is a graph showing the case where the area coverage modulation is 50%. As shown in FIG. 14A, in Embodiment 3, until the developing contrast is 240 V, the target density Dtgt of the toner image for measurement of the area coverage modulation of 90% is set to 1.3 so that the reflection density of the image at the maximum density becomes less than 1.45. The target density Dtgt is set so that, until the developing contrast is 240 V, the reflection density of the fixed image of the toner image for measurement becomes 1.3.

In a range in which the developing contrast is from 240 V to 400 V, the developing contrast is determined along the point at which the curve of the toner bearing amount with respect to the developing contrast is saturated. With a straight line connecting the point at which the developing contrast is 240 V and the target density Dtgt is 1.3, and the point at which the developing contrast is 400 V and the target density Dtgt is 1.1, the target density Dtgt in the range in which the developing contrast is from 240 V to 400 V is set.

With use of such a function of the target density Dtgt, in the case where the measurement results of the toner bearing amount in the setting mode are as represented by the solid line "a", the developing contrast is set to 260 V. In the case where the measurement results of the toner bearing amount in the setting mode are as represented by the broken line a', the developing contrast is set to 300 V. At this time, the change in reflection density of the fixed halftone image before and after the setting mode is performed is 0.05, and the bleeding image phenomenon in the thin line image in the main scanning direction is not observed. When the change in reflection density of the fixed halftone image is 0.05, the image is within a level that is generally regarded as the same density. Further, the difference in reflection density of the fixed maximum density image before and after the setting mode is performed is 0.04, and thus such a reproducibility that the reflection density remains almost unchanged from the original reflection density can be obtained, and the bleeding image phenomenon does not occur as well.

Embodiment 4

In Embodiment 4, a case where the density correction in the medium gray scale is not performed will be described. In Embodiment 4, other points that are not particularly described are the same as those in Embodiment 2.

As illustrated in FIG. 2, the image forming apparatus 100 includes the memory 140 configured to store image data. The control portion 110 subjects the 8-bit image data sent from the external terminal (computer) 150 or the like to dither matrix processing to convert the 8-bit image data into a binary image whose gray level is expressed by area coverage modulation, and causes the memory 140 to store the binary image. The control portion 110 binarizes the image data in consideration of the output characteristic of the gray level of the image forming apparatus 100 at the time point when the image data is sent.

Specifically, the control portion 110 measures how the density changes in response to the input signal at a predetermined timing with use of a density detecting unit, and performs correction with use of a 8-bit to 8-bit gamma lookup table (γLUT) for reversely converting the characteristic thereof. After that, the control portion 110 binarizes the image data through dither matrix processing. As described above, by converting an image which is originally 8-bit into a 1-bit image (binarizing), the capacity of the memory 140 for storage can be reduced, and the processing speed can be improved. In other words, the output speed can be improved at low cost. Then, the user can call the binarized image data stored in the memory 140 as necessary to immediately start printing.

By the way, in a case where the user prints the image after a brief interval from the time when the image data is stored in the memory 140, in some cases, the output characteristic of the gray level of the image forming apparatus 100 may be changed from the time when the image data is binarized due to the change in developing performance of the image forming apparatus 100. When printing is performed in this state, an image whose apparent density in gray level is significantly different from the original one may be output.

However, in the binarized image data, its density information for each pixel is lost, and hence 8-bit to 8-bit γLUT conversion for correcting the density of each pixel on a one-to-one basis cannot be performed. In the image data that has been once compressed to 1 bit, the information amount is reduced, and reconversion to the original 8-bit image is impossible. Therefore, correction through image processing (γLUT) is very difficult.

In this case, in the image forming apparatus 100, the adjustment mode described in Embodiment 2 is executed, and thus the density correction can be performed while suppressing the change in developing performance in the medium gray scale as much as possible. Even when the binarized image data is printed and output after the developing performance is changed, the change in density of the medium gray scale can be suppressed to be small.

In Embodiment 4, the case where the image data is binarized and the γLUT conversion cannot be performed is described. However, even when the medium gray scale can be corrected by the 8-bit to 8-bit γLUT conversion, there is an advantage of replacing with the adjustment mode of Embodiment 2. This is because, by executing the adjustment mode of Embodiment 2 without performing the 8-bit to 8-bit γLUT conversion, the density control of the maximum density and the correction control of the medium gray scale can be both performed simultaneously to prevent occurrence of the down-time.

For example, only when the power is turned ON, the control by the developing contrast using the toner image for measurement at almost the maximum density (image density stabilizing control for the maximum image density) and the correction of the medium density by image processing (γLUT) are performed. On the other hand, during use thereafter, merely the control with use of the toner image for measurement at almost the maximum density is performed, considering the halftone density described in Embodiments. With this, while reducing the down-time during usage by the user as much as possible, the change in the maximum density and in the halftone density can be suppressed to a predetermined value or less.

Specifically, when the user turns the power ON every morning, the two controls using the developing contrast and γLUT are performed. After that, at the frequency of once in passage of 1,000 sheets of A4-sized recording materials, merely the control using the developing contrast is performed. With this, as compared to the case where both the controls are performed for every 1,000 sheets, time taken for control is decreased by half.

Embodiment 5

In Embodiment 1, the control of stabilizing the toner bearing amount of the toner image at the medium gray scale by adjusting the developing contrast is described. However, even when the amplitude or the frequency of the AC voltage of the oscillation voltage to be applied to the developing sleeve is changed, the developing performance of the toner image with respect to the same electrostatic image can be changed. Therefore, the function of the target density Dtgt may be similarly set by taking, instead of the developing contrast, the amplitude or the frequency of the AC voltage as the horizontal axis of the graph.

In Embodiment 1, an embodiment of the present invention in which the image forming apparatus is configured to directly transfer the toner image from the photosensitive drum onto the recording material is described. However, Embodiments 1 and 2 are applicable to another embodiment of the present invention in which the image forming apparatus is configured to transfer the toner image from the photosensitive drum via an intermediate transfer member onto the recording material.

In Embodiment 1, an embodiment of the present invention in which a developing device uses one-component developer is described. However, Embodiments 1 and 2 are applicable to another embodiment of the present invention in which the developing device uses two-component developer.

In Embodiment 1, an embodiment of the present invention in which the image forming apparatus includes one photosensitive drum and is configured to output a monochrome image is described. However, Embodiments 1 and 2 are applicable to another embodiment of the present invention in which the image forming apparatus includes four photosensitive drums and is configured to output a full-color image.

In the image forming apparatus of the present invention, in the setting mode, the target value for setting the setting condition is set lower as the setting condition transits from the higher side to the lower side in developability. Therefore, the down-time for the gamma correction can be eliminated.

Further, as compared to the case where the target value is kept constant, the setting condition electrically defining the developability of the toner image between the developer carrying member and the image bearing member at the time of image formation can be set so that the densities of both of the maximum density image and the halftone image are reproducible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-127378, filed Jun. 4, 2012, which is hereby incorporated by reference herein in its entirety.

What is claimed is:

1. An image forming apparatus, comprising:

an image bearing member;

a developing device configured to develop an electrostatic image formed on the image bearing member;

a sensor configured to detect a toner bearing amount of a toner image developed by the developing device;

a converting portion configured to convert input image information from multivalued information to binarization information;

a storage device configured to store the binarization information converted by the converting portion; and a control portion configured to perform an image forming operation based on the binarization information stored in the storage device, wherein the control portion controls a developing contrast at a time of image formation based on a plurality of detection results obtained by the sensor detecting a plurality of toner images for measurement formed under conditions different in the developing contrast and a preset target value corresponding to the developing contrast to be set, and wherein in a case where the developing contrast to be set is a first developing contrast, the target value is set to a first target value, and in a case where the developing contrast to be set is a second developing contrast greater than the first developing contrast, the target value is set to a second target value different from the first target value so that a toner bearing amount in a maximum image density becomes lower than when the developing contrast to be set is the first developing contrast.

2. An image forming apparatus according to claim 1, wherein, in a case where the developing contrast to be set is less than a predetermined contrast, the target value is set to a constant value.

3. An image forming apparatus according to claim 1, wherein the plurality of toner images for measurement is formed with use of an area coverage modulation of 90% or more.

4. An image forming apparatus according to claim 1, wherein the target value is set so that a difference in the toner bearing amount between halftone images formed in the case where the developing contrast to be set by the control portion is the first developing contrast and in the case where the developing contrast to be set by the control portion is the second developing contrast, respectively, is smaller than a difference in the toner bearing amount between solid images formed in the respective cases.

5. An image forming apparatus according to claim 1, wherein in a case where the developing contrast to be set is at least within a predetermined range, the target value is set so that the toner bearing amount in the maximum image density is lowered with an increase in the developing contrast.

* * * * *